US005926903A

United States Patent [19]

Kim

[11] Patent Number: 5,926,903

[45] Date of Patent: Jul. 27, 1999

[54] MAKE-UP BRUSH WITH REPLACEABLE BRUSHING HEAD

[75] Inventor: Soon Suk Kim, Seoul, Rep. of Korea

[73] Assignee: Seinazur Cosmetics Co., Ltd., Seoul, Rep. of Korea

[21] Appl. No.: 08/902,139

[22] Filed: Jul. 30, 1997

[30] Foreign Application Priority Data

Apr. 29, 1997 [KR] Rep. of Korea ..... 97-9102
Jun. 23, 1997 [KR] Rep. of Korea ..... 97-15260

[51] Int. Cl.[6] ..... A46B 7/04

[52] U.S. Cl. ..... 15/176.2; 15/176.1; 15/176.3

[58] Field of Search ..... 15/176.1, 176.2, 15/176.3, 168, 191.1, 194, 204, 205

[56] References Cited

U.S. PATENT DOCUMENTS 1,082,922 12/1913 Bemis ..... 15/194
2,293,302 8/1942 Morck ..... 15/176.3
2,642,610 6/1953 Erik ..... 15/176.2
4,471,507 9/1984 Schwartz ..... 15/194

FOREIGN PATENT DOCUMENTS 176736 10/1906 Germany ..... 15/191.1
0314879 10/1934 Italy ..... 15/176.1
27252 3/1903 United Kingdom ..... 15/194

*Primary Examiner*—Randall E. Chin
*Attorney, Agent, or Firm*—Dilworth & Barrese

[57] ABSTRACT

The present invention provides a make-up brush which comprises a brushing head and a stem, wherein both of the brushing head and the stem are separably combined. The user of the make-up brush can select a stem and a brushing head from a group of various stems and brushing heads to assemble brush.

9 Claims, 5 Drawing Sheets

MAKE-UP BRUSH WITH REPLACEABLE BRUSHING HEAD

BACKGROUND OF THE INVENTION

1. Field of the Invention

The present invention relates to a make-up brush, and more particularly to a make-up brush with replaceable brushing heads which enables a user to select a stem and a brushing head from a group of various stems and brushing heads to assemble his favorite brush.

2. Description of the Prior Art

As well known to those skilled in the art, a make-up brush is used for applying cosmetic products such as eyeshadow or eyeliner onto a user's face, skin or for other similar purposes.

The make-up brush normally needs to have a size or shape suitable for a certain objective region in a user's face. Therefore, a number of brushes with different shapes or sizes form a brush set and are actually sold and maintained as a set.

The brushing head is formed with a bundle of bristles and combined with an appropriate stem to make an integral brush.

Meanwhile, the conventional make-up brushes have the following drawbacks;

It is very difficult to find such a brush which can catch after a user's fancy and is applicable for all uses. Resultantly, the user occasionally has not only to use an unfavorite brush against his will but also keep even a brush in little use.

Moreover, the user is compelled to discard a complete brush with a still usable stem, when bristles of the brushing head get worn out or fallen off due to a long-term use. This results in a considerable waste of resources and money.

SUMMARY OF THE INVENTION

The present invention has been made in view of the above mentioned problems involved in the prior art and an object of the invention is to provide a make-up brush which enables a user to select its brushing head or stem according to his preference or the cosmetic product to use.

To accomplish the foregoing object, a make-up brush of this invention comprises a brushing head and a stem, replaceable respectively.

According to the invention, the brushing head and the stem can be easily assembled or disassembled.

BRIEF DESCRIPTION OF THE DRAWINGS

The above object and other advantages of the present invention will become more apparent by the following detailed description of the preferred embodiments thereof with reference to the accompanying drawings, in which.

DETAILED DESCRIPTION OF THE PREFERRED EMBODIMENTS

Hereinafter, the present invention will be described in detail with reference to the accompanying drowings and in comparison with the conventional make-up brush.

Figure 1:
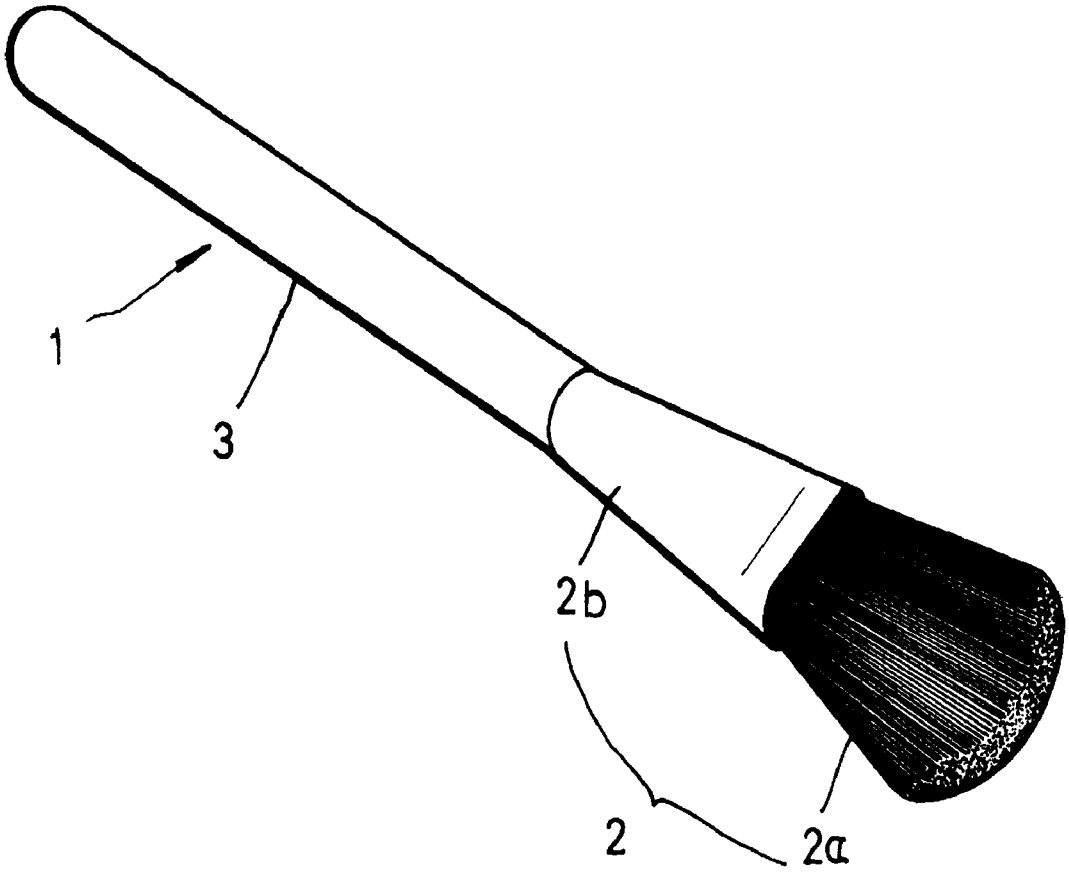
FIG. 1 is a perspective view showing a conventional make-up brush.

A conventional make-up brush is shown in FIG. 1. A brushing head 2 and a stem 3 are tightly combined to form a make-up brush 1. The brushing head 2 is composed of bristles 2*a* and a tubular body 2*b*. Bristles 2*a* are inserted and kept into the upper portion of a metallic tube 2*b*, the upper portion of which is pressed to grip the bristles 2*a* tightly therein. The lower portion of the tubular body 2*b* still remains cylindrical. The stem 3 may be made of plastic or wood, the top end portion of which is so shaped as to match the lower portion of the above tubular body 2*b* and to be fixed in it.

Figure 2:
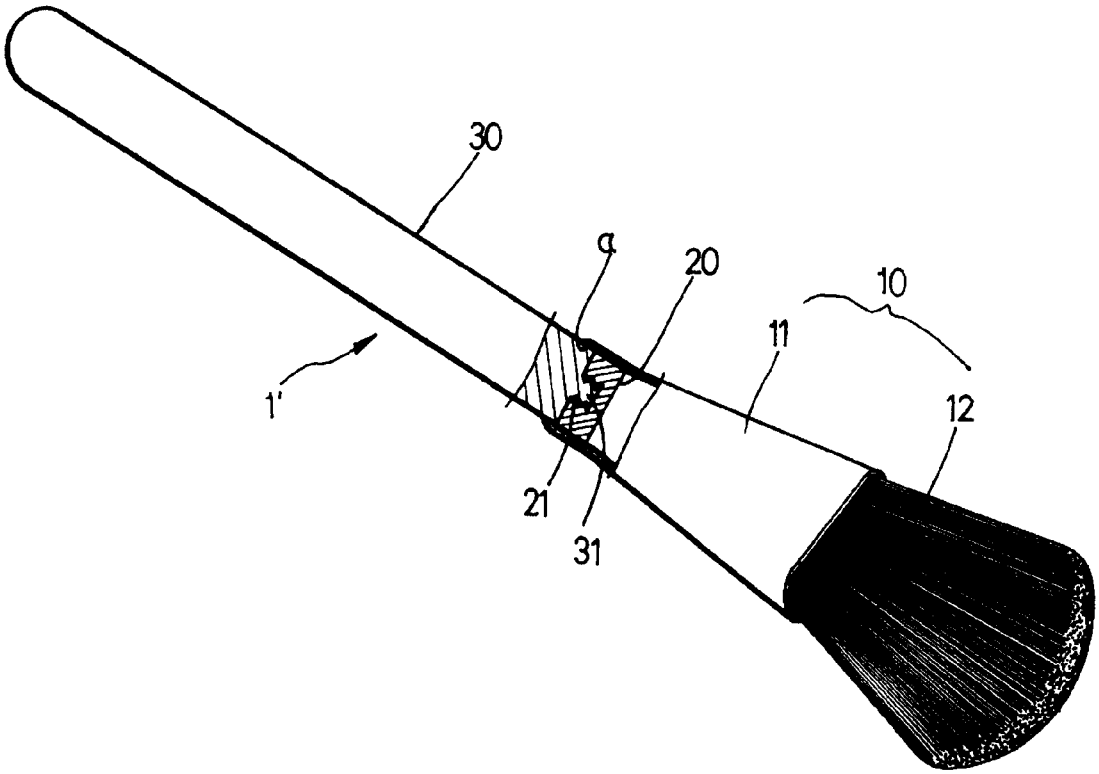
FIG. 2 is a perspective view showing a make-up brush according to the first embodiment of the present invention.

A make-up brush according to the first embodiment of the present invention is shown in FIG. 2, in which a brushing head 10 and a stem 30 are separably combined by means of a connecting member 20 to form a brush 1'.

The connecting member 20 is provided with a screw hole 21 in the lower central portion thereof and fixedly inserted into the hollow of the tubular body 11. Since the connecting member 20 is located inside the hollow of the tubular body 11, there is formed a supporting flange 'a' at the edge of the tubular body 11. The connecting member 20 may be made of plastic, metal, wood or other proper materials.

Meanwhile, on the top of the stem 30, there is provided a screw bolt 31 to engage the screw hole 21 of the connecting member 20.

Figure 3:
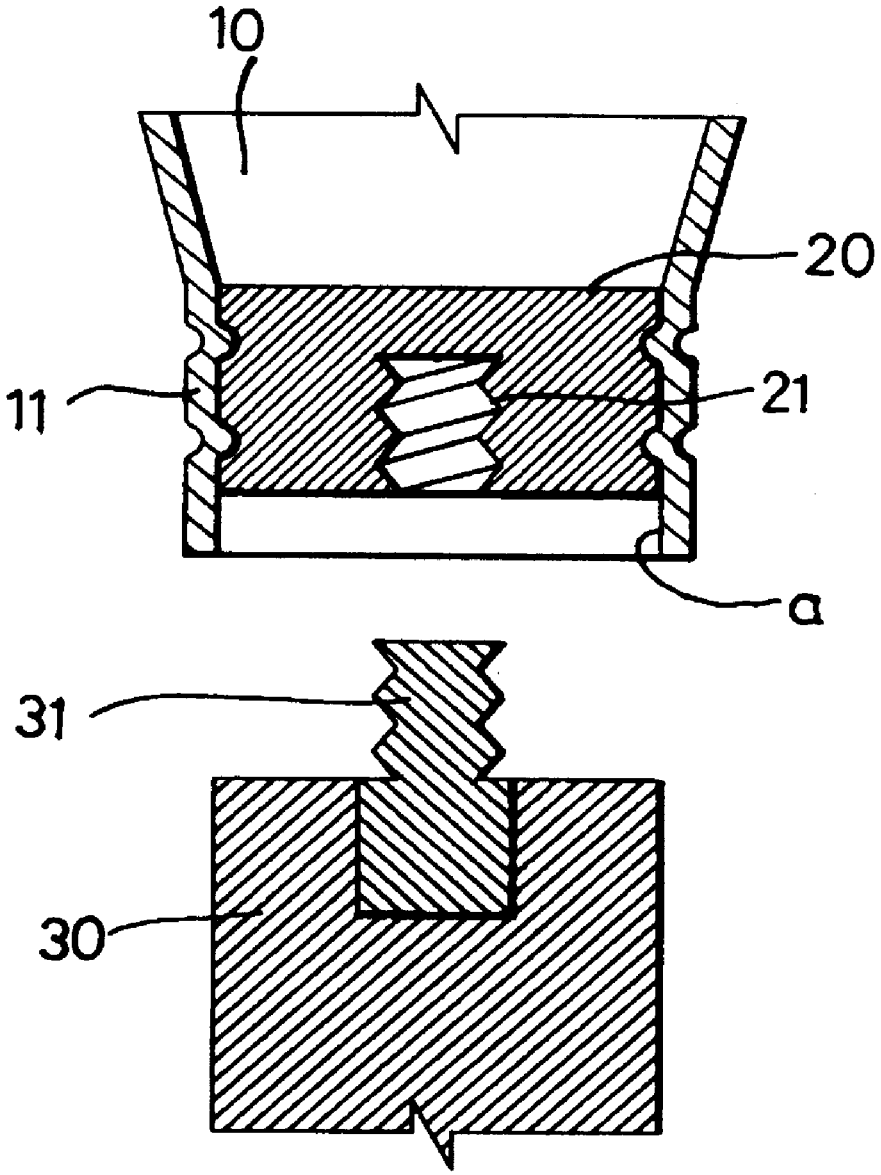
FIG. 3 is a cross-sectional view showing a modified make-up brush of FIG. 1 with a buried screw bolt in the stem.

Further, FIG. 3 shows a modified make-up brush of FIG. 1 with a solid screw bolt 31 buried in the stem 30.

Figure 4:
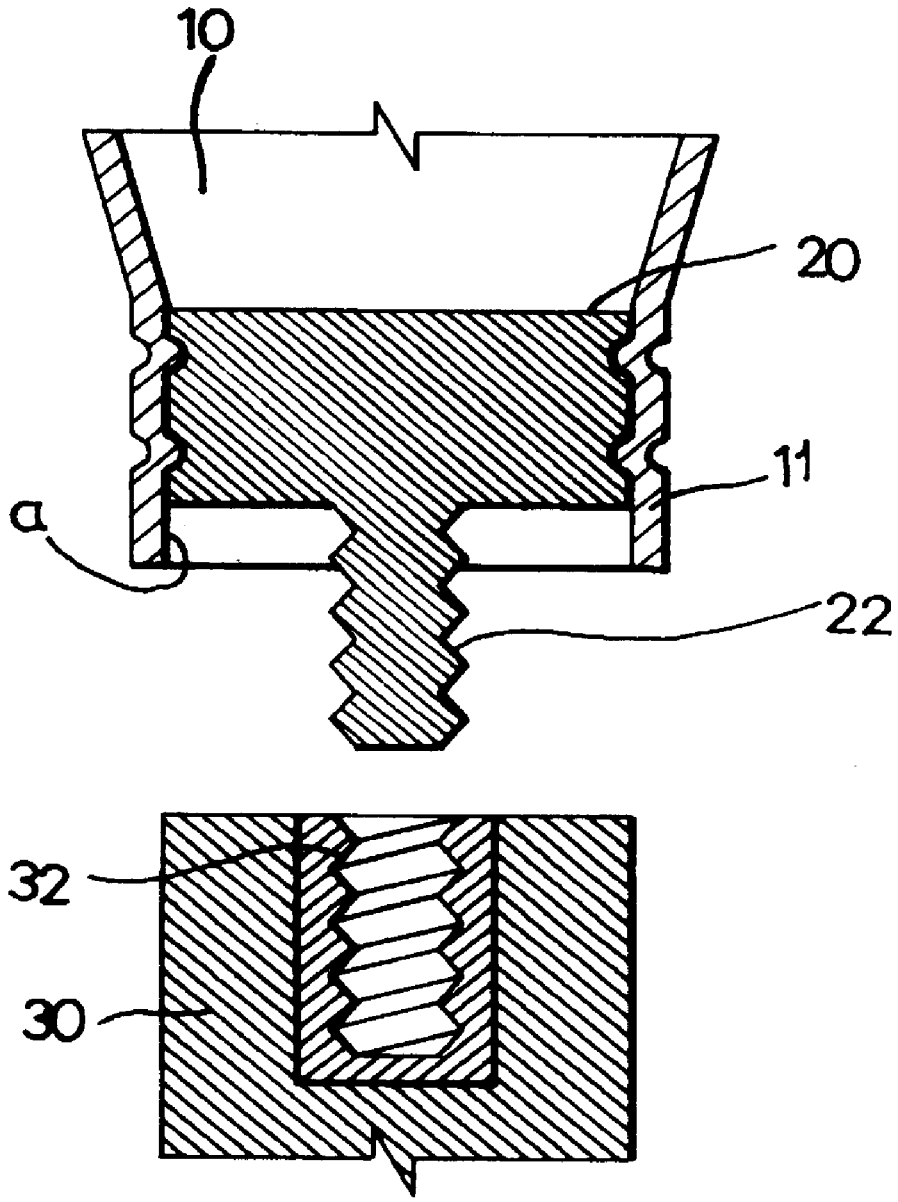
FIG. 4 is a cross-sectional view showing a make-up brush according to the second embodiment of the present invention.

As also shown in FIG. 4 showing a make-up brush according to the second embodiment of this invention, the screw bolt 22 may be provided not in the stem 30 but in the lower end portion of the connecting member 20. In this case, the upper end portion of the stem 30 is provided with a screw hole 32 to accept the above screw bolt 22.

The screw hole 32 may be formed in the stem 30 itself. However, a separate metallic connecting member 32 may also be buried in the wood or plastic stem 30.

Figure 5:
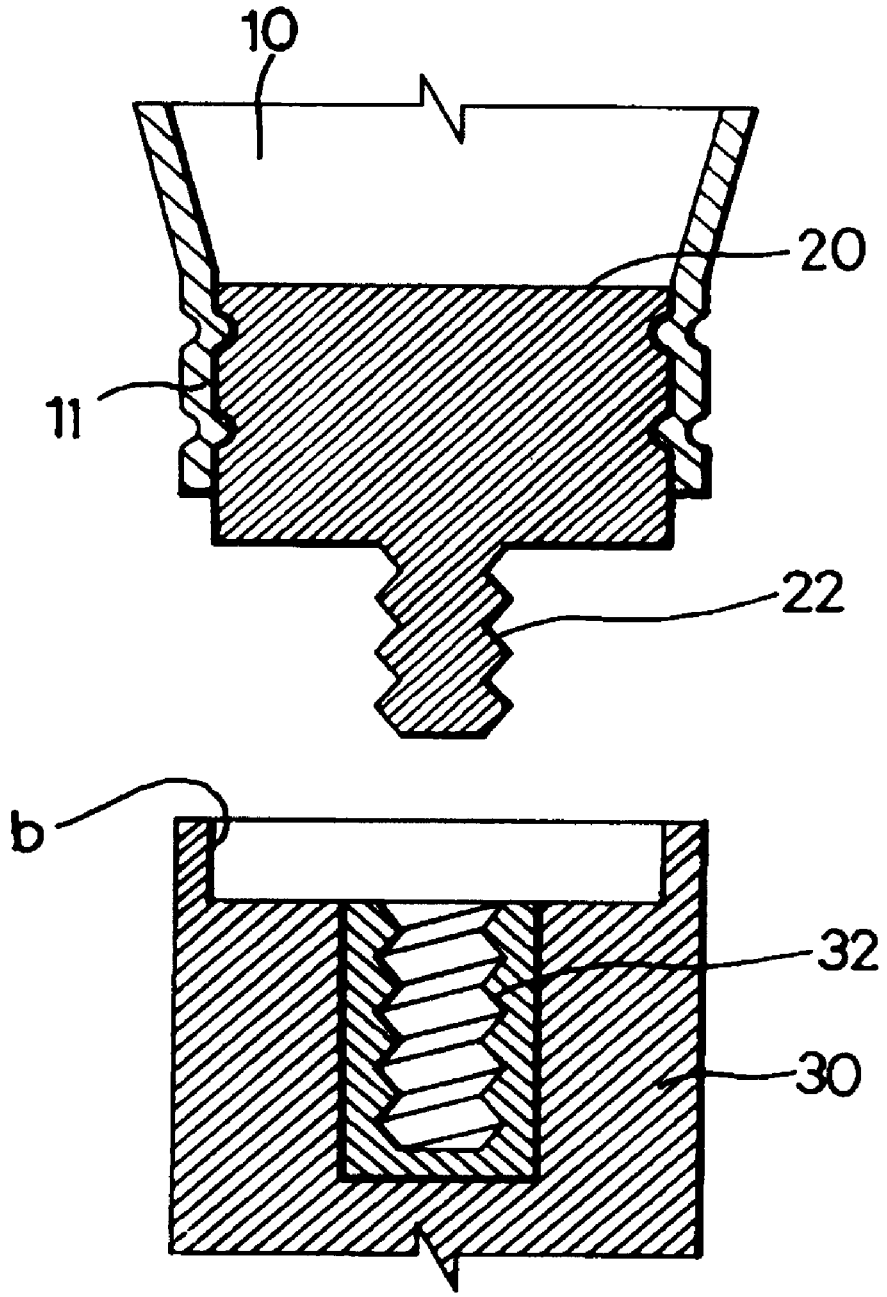
FIG. 5 is a cross sectional view showing a make-up brush according to the third embodiment of the present invention.

FIG. 5 shows a make-up brush according to the third embodiment of the invention, wherein the lower end portion of the connecting member 20 is projected out of the lower end of the tubular body 11, while a supporting flange 'b' to accept the lower end portion of the connecting member 20 is provided at the top of the stem 30. The supporting flange 'b' can be formed by the conventional methods.

Alternatively, the lower end portion of the connecting member 20 projecting out of the tubular body 11 and the upper end portion of the stem 30 may have a equal diameter and the two end portions may engage each other inside a separate supporting ring.

Meanwhile, although the supporting flange in the above embodiments function to ensure the fixation of the connecting member and the stem, it is not a essential element of the present invention. In other words, even without the supporting flange, the object of the present invention can be accomplished as far as the brushing head and the stem are separably connected.

The brushing head and the stem may be combined with each other by utilizing the spring force of a simple elastic body such as a plate spring. This means that the connection methods between the brushing head and the stem are not restricted to the above screw type connection.

As apparent from the foregoing, the present invention provides a make-up brush which enables a user to select its brushing head or its stem according to his preference or the cosmetic product to use and serves the user's convenience thereby.

Further, according to the invention, the user does not have to discard the complete brush with a still usable stem, when the bristles of the brushing head had worn out or fallen off. Accordingly, a considerable waste of resources and money can be prevented.

Although the preferred embodiments of the invention have been disclosed for illustrative purposes, those skilled in the art will appreciate that various modifications, additions and substitutions are possible, without departing from the scope and spirit of the invention as disclosed herein.

What is claimed is:

1. A make-up brush for detachably securing a brushing head (10) and a handle or stem (30) together, comprising:

a tubular body (11), the brushing head (10) with a bundle of bristles (12) kept in one side of the tubular body (11); and a connecting member (20) fixedly inserted in and engaging the other side of the tubular body (11) to separably combine and detachably secure the brushing head (10) and the stem (30) together, wherein a lower end portion of the connecting member (20) is fixedly located inside a hollow portion of the tubular body (11) to define a supporting flange (a) formed at a lower edge of the tubular body (11), whereby different heads and stems can be securely coupled together.

2. A make-up brush for detachably securing a brushing head (10) and handle or stem (30) together, comprising:

a tubular body (11), the brushing head (10) with a bundle of bristles (12) kept in one side of the tubular body (11); and a connecting member (20) fixedly inserted in and engaging the other side of the tubular body (11) to separably combine an detachably secure the brushing head (10) and the stem (30) together, wherein one of the connecting member (20) and stem (30) is provided with a screw bolt (22) and the other of the connecting member (20) and stem (30) is provided with a screw hole (32) for detachably connecting the brushing head (10) and stem (30) together, whereby different heads and stems can be securely coupled together.

3. A make-up brush as claimed in claim 2, wherein a lower end portion of the connecting member (20) is provided with the screw bolt (22) and an upper end portion of the stem (30) is provided with the screw hole (32), whereby the brushing head (10) and stem (30) can be coupled or uncoupled together by simply screwing or unscrewing the screw bolt (22).

4. A make-up brush as claimed in claim 3, wherein the lower end portion of the connecting member (20) is fixedly located inside a hollow portion of the tubular body (11) to define a supporting flange (a) formed at the lower edge of the tubular body (11).

5. A make-up brush as claimed in claim 4, wherein the screw bolt (22), screw hole (32) and defined supporting flange (a) constitute the sole means of detachably connecting the brushing head (10) and stem (30) together.

6. A make-up brush as claimed in claim 3, additionally comprising a separate metallic connecting member in which the screw hole (32) is formed and which is buried in the stem (30) which is formed of one of wood and plastic.

7. A make-up brush as claimed in claim 4, additionally comprising a separate metallic connecting member in which the screw hole (32) is formed and which is buried in the stem (30) which is formed of one of wood and plastic.

8. A make-up brush as claimed in claim 2, wherein the screw bolt (22) and complementary screw hole (32) constitute the sole means of detachably connecting the brushing head (10) and stem (30) together.

9. A make-up brush as claimed in claim 2, wherein the stem (30) is formed of plastic and the connecting member (20) is formed of one of plastic, metal and wood.

* * * * *